US010748690B2

(12) United States Patent
Jonas et al.

(10) Patent No.: US 10,748,690 B2
(45) Date of Patent: Aug. 18, 2020

(54) METHOD AND DEVICE FOR CONTROLLING COOLING LOOP FOR SUPERCONDUCTING MAGNET SYSTEM IN RESPONSE TO MAGNETIC FIELD

(71) Applicant: KONINKLIJKE PHILIPS N.V., Eindhoven (NL)

(72) Inventors: Philip Alexander Jonas, Delmar, NY (US); Robert Adolph Ackermann, Latham, NY (US); Philippe Abel Menteur, Latham, NY (US)

(73) Assignee: Koninklijke Philips N.V., Eindhoven (NL)

( * ) Notice: Subject to any disclaimer, the term of this patent is extended or adjusted under 35 U.S.C. 154(b) by 514 days.

(21) Appl. No.: 14/906,956

(22) PCT Filed: Jul. 25, 2014

(86) PCT No.: PCT/IB2014/063416

§ 371 (c)(1),
(2) Date: Jan. 22, 2016

(87) PCT Pub. No.: WO2015/011679

PCT Pub. Date: Jan. 29, 2015

(65) Prior Publication Data

US 2016/0189842 A1 Jun. 30, 2016

Related U.S. Application Data

(60) Provisional application No. 61/858,785, filed on Jul. 26, 2013.

(51) Int. Cl.
*H01F 6/04* (2006.01)

(52) U.S. Cl.
CPC ..... *H01F 6/04* (2013.01)

(58) Field of Classification Search
CPC ..... H01F 6/04; H01F 6/06; F25D 3/10
USPC ..... 165/96; 137/486
See application file for complete search history.

(56) References Cited

U.S. PATENT DOCUMENTS 4,655,045 A * 4/1987 Matsumoto ..... G01R 33/3815 505/892
4,841,268 A * 6/1989 Burnett ..... H01F 6/065 174/15.4
5,379,600 A * 1/1995 Moritsu ..... F17C 3/085 505/892
5,385,010 A * 1/1995 Horn ..... F25B 9/14 62/298
5,410,286 A 4/1995 Herd et al.
5,461,873 A * 10/1995 Longsworth ..... F25B 9/14 505/892
5,463,872 A * 11/1995 Vader ..... H01L 23/445 165/80.4

(Continued)

FOREIGN PATENT DOCUMENTS

JP 2009246231 A 10/2009
WO 0196020 A1 12/2001
WO 2015011679 A1 1/2015

*Primary Examiner* — Tho V Duong
*Assistant Examiner* — Raheena R Malik

(57) ABSTRACT

A valve is configured to control a flow of a gas disposed within a convective cooling loop. The valve can be actuated between an open position and a closed position via a magnetic field generated by at least one electrically conductive coil disposed within a cryostat.

19 Claims, 11 Drawing Sheets

(56) References Cited

U.S. PATENT DOCUMENTS

| | | | | |
|---|---|---|---|---|
| 5,724,820 | A | 3/1998 | Iwasa | |
| 5,917,393 | A | 6/1999 | Kupiszeswki | |
| 7,053,740 | B1 | 5/2006 | Laskaris et al. | |
| 7,319,329 | B2 | 1/2008 | Huang et al. | |
| 7,430,871 | B2 | 10/2008 | Strobel | |
| 8,820,347 | B2 | 9/2014 | Mann | |
| 2006/0236709 | A1 | 10/2006 | Steinmeyer | |
| 2007/0101742 | A1 | 5/2007 | Laskaris et al. | |
| 2007/0236709 | A1 | 10/2007 | Mitani | |
| 2008/0242974 | A1 | 10/2008 | Urbahn | |
| 2009/0277517 | A1* | 11/2009 | Mann | F25D 3/10 137/486 |
| 2010/0022395 | A1* | 1/2010 | Bittner | F25B 45/00 505/163 |
| 2011/0179667 | A1* | 7/2011 | Lee | F26B 5/06 34/287 |
| 2011/0210729 | A1* | 9/2011 | Iwasa | G01R 33/3802 324/307 |
| 2014/0018243 | A1* | 1/2014 | Gross | G01R 33/3804 505/162 |
| 2015/0323626 | A1 | 11/2015 | Jonas | |
| 2016/0103193 | A1* | 4/2016 | Kwon | G01R 33/3815 324/322 |
| 2016/0233011 | A1* | 8/2016 | Eguchi | G01R 33/3804 |

* cited by examiner

METHOD AND DEVICE FOR CONTROLLING COOLING LOOP FOR SUPERCONDUCTING MAGNET SYSTEM IN RESPONSE TO MAGNETIC FIELD

CROSS REFERENCE TO RELATED APPLICATIONS

This application is a U.S. national phase application of International Application No. PCT/IB2014/063416 filed on Jul. 25, 2014, which claims the benefit of U.S. Provisional Patent Application Ser. No. 61/858,785 filed on Jul. 26, 2013 and is incorporated herein by reference.

TECHNICAL FIELD

The present invention generally pertains to a convective cooling loop for use with a superconducting persistent magnet in a cryogenic environment.

BACKGROUND AND SUMMARY

Superconducting magnets are used in a variety of contexts, including nuclear magnetic resonance (NMR) analysis, and magnetic resonance imaging (MRI). To realize superconductivity, a magnet is maintained in a cryogenic environment at a temperature near absolute zero. Typically, the magnet includes one or more electrically conductive coils which are disposed in a cryostat and through which an electrical current circulates to create the magnetic field.

There are many ways to maintain the electrically conductive coil(s) at cryogenic temperatures so that they are superconducting during normal operation.

One method is to employ one or more cooling tubes in a cooling loop to circulate a gas between the electrically conductive coil(s) and a cold station so as to transfer heat from the electrically conductive coil(s) and the cold station. The cold station is typically some structure with a relatively large thermal mass, and can be used to keep the electrically conductive coils cold for a short period of time if the refrigeration system is turned off or is not operative. Such cooling tube(s) may efficiently transfer heat from the electrically conductive coil to the cold station whenever the cold station is at a lower temperature than the electrically conductive coil(s).

However, in some situations it is possible for conditions within the cryostat to degrade and the temperature of the magnet (i.e., electrically conductive coil(s)) may begin to rise. This may happen, for example, if refrigeration capability for the cryogenic environment is lost, for example due to a loss of electrical power for the compressor (i.e., a power outage). At a certain point, if cooling of the magnet's environment within the cryostat is not restored, then the magnet's temperature will rise to reach the so-called critical temperature where the magnetic field will "quench" and the magnet will convert its magnetic energy to heat energy. In that case, the temperature of the electrically conductive coil(s) may rise well above the cold station's temperature, and the heat sink capacity of the cold station may be wasted. Furthermore, if the cold station is heated by the electrically conductive coil(s), it may need to be re-cooled by the cryostat's refrigeration system in order to bring the superconducting magnet system back to normal operation. This can cause the time to recover from a quench to be extended.

Additionally, in some superconducting magnet systems (for example, so-called "cryofree systems") the magnet is maintained in a vacuum environment and is cooled by a sealed system (e.g., a cold plate) which is filled with a cryogenic fluid, for example liquid helium. In such systems, it is beneficial to provide a getter on or near the cold station within the vacuum environment so as to absorb stray molecules that may be released into the vacuum, as such stray molecules can become a mechanism for heat transfer. In that case, if the cold station is allowed to heat up, then the stray molecules which have been captured by the getter may be released into the chamber. If that occurs, an expensive and time-consuming vacuum pump down of the cryostat may be required to remove the released molecules.

Therefore, in a case where an electrically conductive coil rises in temperature as the magnetic field is quenched, it would be desirable to thermally disconnect or isolate the electrically conductive coil from the cold station so that the heat from the electrically conductive coil does not heat up the cold station. More specifically, in a case where the magnetic field is quenched and the electrically conductive coil rises in temperature, it would be desirable to open the cooling loop which would otherwise transfer heat from the electrically conductive coil to the cold station.

However, because the cooling loop typically has high gas (e.g., helium gas) inside, is disposed in a high vacuum environment, and operates at very low cryogenic temperatures, manual valves or solenoid operated valves (which also have large heat dissipation) are not very suitable for controlling flow within the cooling loop, for example to prevent circulation within the cooling loop when the electrically conductive coil is heated due to a quench.

Accordingly, it would be desired to provide a method and device for automatically prevent circulation within the cooling loop when the electrically conductive coil is heated dues to a quench without external control.

One aspect of the present invention can provide a method including: actuating a valve of a convective cooling loop between a closed position and an open position via a magnetic field generated by at least one electrically conductive coil disposed within a cryostat, wherein actuation of the valve controls flow of a gas disposed within the convective cooling loop.

In some embodiments, the method can further include cooling the electrically conductive coil via a sealed system having liquid helium disposed therein.

In some embodiments, opening the valve in the convective cooling loop can include displacing a magnetically reactive sealing element of the valve with respect to a sealing surface of the valve in response to the magnetic field having at least the threshold magnetic field gradient, to thereby open the valve.

In some embodiments, actuating the valve in the convective cooling loop can include displacing a magnetically reactive element of the valve in response to the magnetic field having at least the threshold magnetic field gradient, wherein displacing the magnetically reactive element causes a nonmagnetic sealing element of the valve to be displaced with respect to a sealing surface of the valve to open the valve.

In some embodiments, actuating the valve in the convective cooling loop can include employing at least one of gravity and a force produced by a pressure of the gas to cause a sealing element of the valve to be disposed against a sealing surface of the valve to close the valve.

In some embodiments, actuating the valve in the convective cooling loop can include employing a force produced by a spring in the valve to cause a sealing element of the valve to be disposed against a sealing surface of the valve to close the valve.

In some embodiments, actuating the valve in the convective cooling loop in response to the magnetic field can include applying the magnetic field oriented in a direction perpendicular to direction of a flow of the gas from an inlet of the valve to an outlet of the valve to open the valve.

In some embodiments, actuating the valve in the convective cooling loop in response to the magnetic field can include applying the magnetic field oriented in a direction parallel to direction of a flow of the gas from an inlet of the valve to an outlet of the valve to open the valve.

Another aspect of the present invention can provide an apparatus including: a convective cooling loop; and a valve configured to control a flow of a gas disposed within the convective cooling loop, wherein the valve is configured to be actuated between an open position and a closed position via a magnetic field generated by at least one electrically conductive coil disposed within a cryostat.

In some embodiments, the valve can include a sealing element and a sealing surface configured so that when the electrically conductive coil is not energized, the sealing element is mated to the sealing surface such that the valve is closed so as to prevent the flow of the gas within the cooling loop, and a magnetically reactive element, wherein in response to the magnetic field of the electrically conductive coil, the magnetically reactive element is configured to cause the sealing element to be displaced with respect to the sealing surface such that the valve is opened and the flow of the gas within the cooling loop is enabled.

In some embodiments, the magnetically reactive element can include a ferromagnetic material.

In some embodiments, the sealing element can include the magnetically reactive element.

In some embodiments, the sealing element can be non-magnetic, and the magnetically reactive element can be attached to the sealing element such that when the magnetically reactive element is displaced by the magnetic field of the electrically conductive coil, the magnetically reactive element can in turn displace the sealing element with respect to the sealing surface such that the valve can be opened.

In some embodiments, when the electrically conductive coil is not energized, the sealing element can be held against the sealing surface at partially by gravity to close the valve.

In some embodiments, the valve can further include a spring, wherein when the electrically conductive coil is not energized, the sealing element can be held against the sealing surface at partially by a force produced by the spring to close the valve.

In some embodiments, the valve further includes a lever having a beam and a fulcrum, wherein the magnetically reactive element can be disposed at a first end of the lever at a first side of the fulcrum, and the sealing element can be disposed at a second end of the lever at a second side of the fulcrum, wherein when the magnetically reactive element is displaced by the magnetic field of the electrically conductive coil it can operate the lever so as to displace the sealing element with respect to the sealing surface such that the valve can be opened.

Yet another aspect of the present invention can provide an apparatus including: a cooling tube configured to circulate a gas therethrough to allow thermal energy to be transferred from a first device to a second device; and a valve disposed in a gas flow path of the cooling tub. The valve can include: a valve housing having an inlet and an outlet, and a sealing element and a sealing surface disposed within the valve housing, wherein the sealing element can be configured to be displaced with respect to the sealing surface to switch the valve between an open position and a closed position via a magnetic field.

In some embodiments, the sealing element can be configured to be mated to the sealing surface to close the valve and prevent a flow of the gas between the inlet and the outlet in the absence of the magnetic field, and is further configured to be displaced with respect to the sealing surface to open the valve and permit a flow of the gas between the inlet and the outlet in the presence of the magnetic field.

In some embodiments, the seating element can include a magnetically reactive material.

BRIEF DESCRIPTION OF THE DRAWINGS

The present invention will be more readily understood from the detailed description of exemplary embodiments presented below considered in conjunction with the accompanying drawings.

DETAILED DESCRIPTION

The present invention will now be described more fully hereinafter with reference to the accompanying drawings, in which embodiments of the present invention are shown. The present invention may, however, be embodied in different forms and should not be construed as limited to the embodiments set forth herein. Rather, these embodiments are provided as teaching examples of the invention. Within the present disclosure and claims, when something is said to have approximately a certain value, then it means that it is within 10% of that value, and when something is said to have about a certain value, then it means that it is within 25% of that value.

Figure 1:
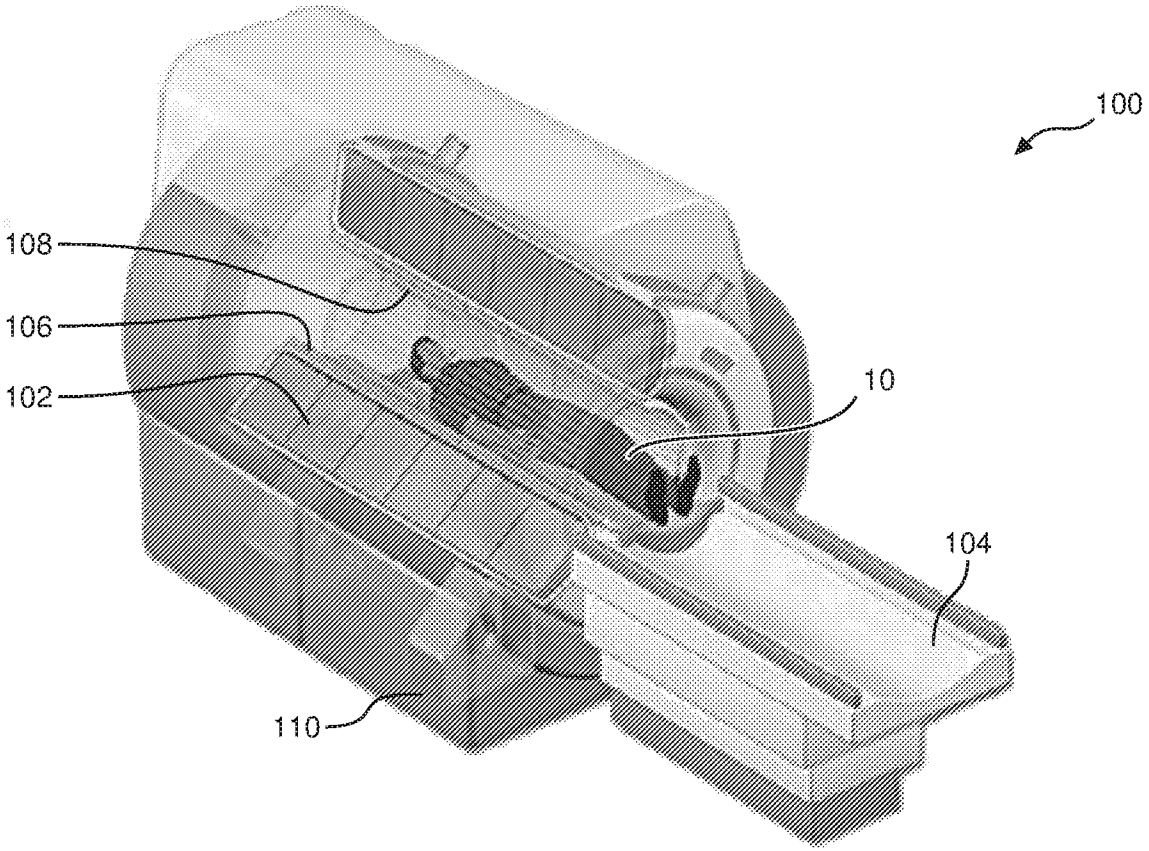
FIG. 1 illustrates an exemplary embodiment of a magnetic resonance imaging (MRI) apparatus.

FIG. 1 illustrates an exemplary embodiment of a magnetic resonance imaging (MRI) apparatus 100. MRI apparatus 100 may include a magnet 102; a patient table 104 configured to hold a patient 10; gradient coils 106 configured to at least partially surround at least a portion of patient 10 for which MRI apparatus 100 generates an image; a radio frequency coil 108 configured to apply a radio frequency signal to at least the portion of patient 10 which is being imaged, and to alter the alignment of the magnetic field; and a scanner 110 configured to detect changes in the magnetic field caused by the radio frequency signal.

The general operation of an MRI apparatus is well known and therefore will not be repeated here.

Figure 2:
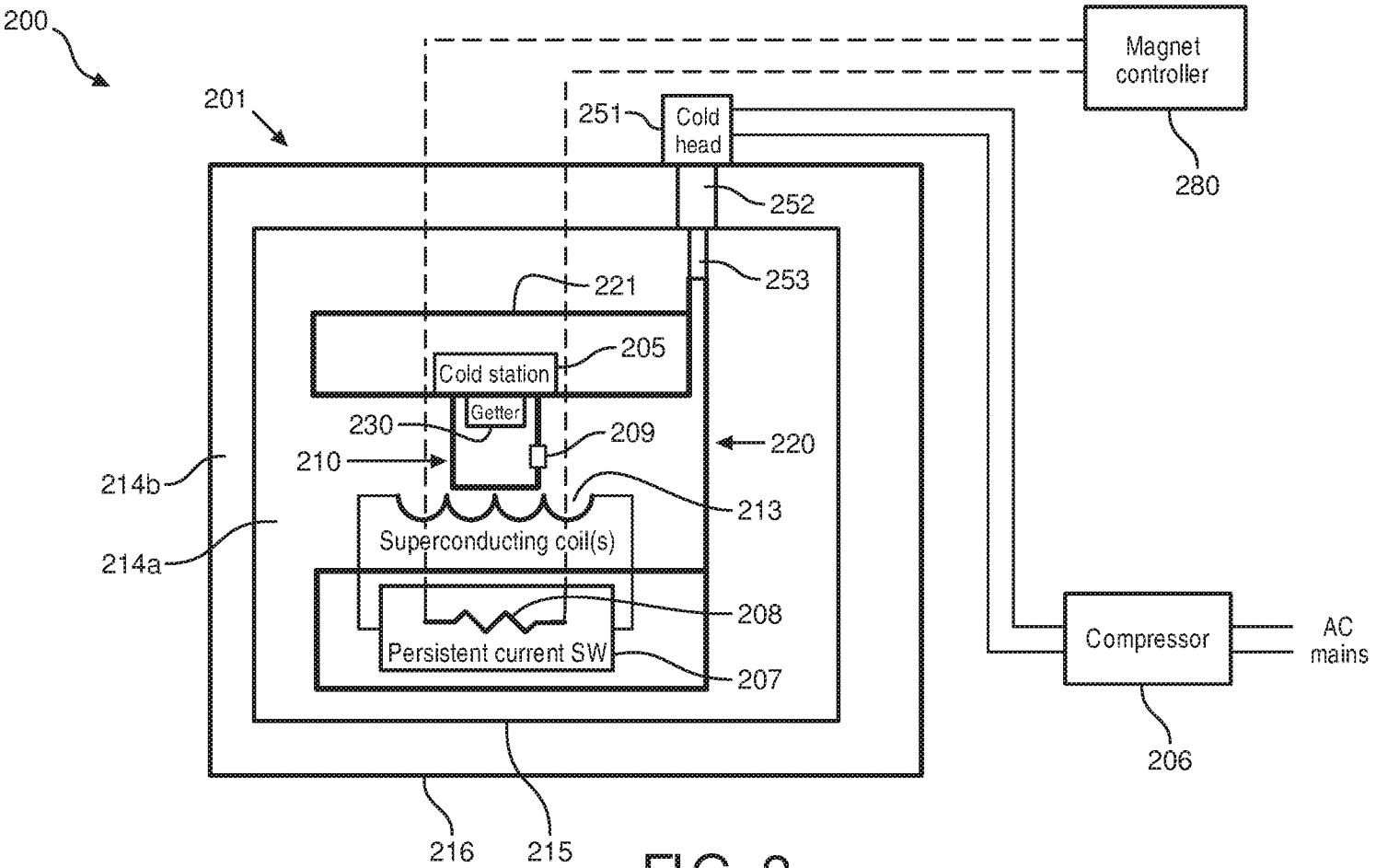
FIG. 2 illustrates an exemplary embodiment of a superconducting magnet system which may be employed in an MRI apparatus.

FIG. 2 illustrates an exemplary embodiment of a superconducting magnet system 200. Superconducting magnet system 200 may be employed in an MRI apparatus such as MRI apparatus 100.

Superconducting magnet system 200 may include a cryostat 201 having an enclosure, or outer vacuum vessel, 216 and a thermal shield 215 disposed within enclosure 216. Thermal shield 215 at least partially thermally isolates an inner region 214*a* within enclosure 216 from a thermal insulation region 214*b* disposed between thermal shield 215 and enclosure 216. Here, it should be understood that in general, thermal shield 215 may not completely enclose inner region 214*a*. For example, thermal shield 215 may include openings or apertures for allowing various structures such as a portion of cold head 201, electrical wires or probes, etc., to pass between inner region 214*a* and thermal insulation region 214*b*. In some embodiments, thermal shield 215 may include a structure such as an open-ended cylinder which is not a closed structure but which nevertheless generally defines a region therein. Other shapes and configurations are possible.

Superconducting magnet system 200 may also include: a persistent current switch 207; a persistent current switch heater 208; one or more electrically conductive coil(s) 213; a cold head 251 having associated therewith a first stage element 252 and a second stage element 253; a cold plate 220; a cold station 205; a cooling loop 210; a getter 230; a compressor 206; and a magnet controller 280.

In general, superconducting magnet system 200 may have a number of other elements other than those shown in FIG. 2, including, for example, a power supply for supplying power to electrically conductive coil(s) 213 during system startup, one or more sensors connected to magnet controller 280 for monitoring operation of superconducting magnet system 200, etc.

In one embodiment, persistent current switch 207, persistent current switch heater 208, electrically conductive coil(s) 213, second stage element 253, cold plate 220; cold station 205, cooling loop 210; and getter 230 may be disposed within inner region 214*a*. First stage element 252 of cold head 251 may be disposed within thermal insulation region 214*b*. Compressor 206 and controller 280 may be disposed outside of cryostat 201.

Beneficially, inner region 214*a* and thermal insulation region 214 inside of enclosure 216 may include an evacuated space where any gas, liquid, etc. has been removed, comprising a first vacuum except for the areas occupied by defined structures (e.g., second persistent current switch 207, persistent current switch heater 208, electrically conductive coil(s) 213, second stage element 253, cold plate 220; cold station 205, cooling loop 210; and getter 230, etc.).

In some embodiments, thermal shield 215 may be thermally coupled or connected to first stage element 252 of cold head 251.

Electrically conductive coil(s) 213 may be made of a highly electrically conductive material, such as copper, brass, or aluminum, and beneficially have a low resistance.

Cold station 205 may be a thermal mass (thermal storage element) or heat sink which is operationally maintained at a low temperature (e.g., a cryogenic temperature, such as about 4° K) and has a "large" thermal mass—i.e., a thermal mass which is much larger than that of electrically conductive coil(s) 213 and beneficially may be several times the thermal mass of electrically conductive coil(s) 213. Accordingly, cold station 205 may absorb heat from electrically conductive coil(s) 213 via cooling loop 210 without a much smaller rise in temperature than that which would otherwise occur for electrically conductive coil(s) 213 if the heat was not transferred from it. In some embodiments, cold station 205 may be attached to, or is part of cold head 251, for example second stage element 253 through cooling loop 221 to cool down the cold station.

Cooling loop 210 may include a closed tube (e.g., a copper tube) arranged in a closed loop with a cooling gas (e.g., helium gas) provided therein. In some embodiments, the cooling gas may be under a pressure which is greater than atmospheric pressure.

In some embodiments, cooling loop 210 may be a gravity-fed convective cooling loop and may include a tube which circulates a cold gas (e.g., helium gas) so as to transfer heat from electrically conductive coil(s) 213 to cold station 205. In that case, cold station 205 is disposed at a higher altitude, or position, with respect to earth, than electrically conductive coil(s) 213, so that gravity causes flow in the direction from cold station 205 to electrically conductive coil(s) 213. Due to the gravity-fed convective cooling operation, cooling loop 210 may efficiently transfer heat via convection from electrically conductive coil(s) 213 to cold station 205 whenever cold station 205 is at a lower temperature (is colder) than electrically conductive coil(s) 213, but "shuts off" whenever cold station 205 is at a higher temperature (is hotter) than electrically conductive coil(s) 213.

Getter 230 may operate to absorb stray molecules which become present in the vacuum environment of cryostat 201. In some embodiments, getter 230 (for example, a charcoal activated device) may need to be maintained at a cold temperature (e.g., <about 20° K) in order to absorb and retain the stray molecules; otherwise getter 230 may release the stray molecules back into the vacuum environment. In that case, it may be beneficial to locate getter 230 on or near cold station 205.

In some embodiments, magnet controller 280 may include memory (e.g., volatile and/or nonvolatile memory) and a processor (e.g., a microprocessor). The processor may be configured to execute computer program instructions stored in the memory to cause magnet system 300 to perform one or more actions and/or processes as described herein.

An explanation of an exemplary operation of superconducting magnet system 100 will now be described with respect to FIG. 2.

In operation, cold plate 220 can be a sealed system which has a cryogenic fluid (e.g., liquid or gaseous helium) disposed therein. Cold head 201 is driven by compressor 206 to cool the cryogenic fluid in cold plate 220. In turn, cold plate 220 cools electrically conductive coil(s) 213 to a superconducting temperature (e.g., about 4° K) where electrically conductive coil(s) 213 are superconducting.

During start-up or magnet energization, electrically conductive coil(s) 213 are charged to produce a magnetic field with a desired magnetic field gradient. To accomplish this, persistent current switch heater 208 is activated or turned-on (e.g., under control of magnet controller 380) so as to heat persistent current switch 207 to a resistive mode temperature, which is greater than its superconducting temperature. When persistent current switch 207 is heated to the resistive mode temperature, it is in the resistive state with an impedance preferably in a range of a few ohms or tens of ohms. With persistent current switch 207 in the resistive state, electrically conductive coil(s) 213 are energized by applying power from a power supply (external to cryostat 201 and not illustrated in FIG. 2). This can be performed via electrically conductive charging links (also not illustrated in FIG. 2), thereby causing electrically conductive coil(s) 213 to produce a magnetic field. The magnetic field produced by electrically conductive coil(s) 213 may be ramped up to a desired or target magnetic field gradient by continuing to supply power from the power supply.

After electrically conductive coil(s) 213 have been energized to generate a magnetic field of a desired magnetic field gradient, persistent heater switch 208 is deactivated or turned off (e.g., under control of magnet controller 280), and the power supply is disconnected from electrically conductive coil(s) 213 as magnet system 200 transitions to a normal operating status wherein it maintains its current and magnetic field in "persistent mode."

The arrangement illustrated in FIG. 2 provides two cooling mechanisms or means for dissipating heat from electrically conductive coil(s) 213 and keeping electrically conductive coil(s) 213 cold. However, although only two cooling mechanisms or means for dissipating heat are shown, other embodiments of the present invention can include any number of heat exchange stages/elements and heat dissipation paths for conductive coil(s) 213.

The principal mechanism illustrated in FIG. 2 for dissipating heat from electrically conductive coil(s) 213 is via cold plate 220 which, during normal operation, is continuously cooled by compressor 206 via cold head 251. Cold plate 220 can maintain the electrically conductive coil(s) 213 in the interior vacuum space of inner region 214*a* at a cryogenic temperature (e.g., about 4° K) such that electrically conductive coil(s) 213 is/are superconducting and operates in persistent mode to generate its magnetic field.

However, it is possible that the principal cooling mechanism may become non-operational, for example due to a malfunction of compressor 206, or due to a loss of AC Mains power for operating compressor 206.

In that case, when the primary cooling mechanism via compressor 206 and cold head 251 is not operational, then a secondary or backup cooling mechanism including cooling loop 210 and cold station 205 may operate to dissipate heat from electrically conductive coil(s) 213. The backup mechanism may operate for a period of time to delay or prevent a quench of the magnetic field generated by electrically conductive coil(s) 213, for example for a period of time which may allow the primary cooling mechanism to be restored (e.g., by repairing or replacing compressor 206, restoring electrical power to compressor 206, etc.).

In particular, where cooling loop 210 is a gravity fed convection cooling loop, so long as the electrically conductive coil(s) 213 are at a lower temperature (colder) than cold station 205, for example during normal operation of superconducting magnet system 200, then in a beneficial feature a substantial amount of heat will not be transferred from cold station 205 to electrically conductive coil(s) 213, because convection will not occur within cooling loop 210 as cold station 205 is disposed at a higher altitude, or position, with respect to earth, than electrically conductive coil(s) 213. On the other hand, if the primary cooling mechanism fails to operate and the temperature of electrically conductive coil(s) 213 rises to be greater than that or cold station 205, then the convective action of cooling lop 210 can transfer heat from electrically conductive coil(s) 213 to cold station 205.

However, if the primary cooling mechanism remains nonoperational for an extended period of time, then the temperature of electrically conductive coil(s) 213 may continue to rise and eventually exceed the maximum temperature at which electrically conductive coil(s) 213 is superconducting. At that point, resistive losses in electrically conductive coil(s) 213 become appreciable, the magnetic field is quenched, and electrically conductive coil(s) 213 heat up more rapidly as the magnetic field energy is converted to thermal energy in electrically conductive coil(s) 213.

As explained above, if this should occur, the temperature of electrically conductive coil(s) 213 may rise well above the temperature of cold station 205, and the heat sink capacity of cold station 205 may be wasted. Furthermore, if cold station 205 is heated by the electrically conductive coil(s) 213, it may need to be re-cooled by the cryostat's refrigeration system (e.g., compressor 206, cold head 251, and cold plate 220) in order to bring superconducting magnet system 200 back to normal operation. This can cause the time to recover from a quench to be extended.

Additionally, if the temperature of cold station 205 is rapidly heated by heat electrically conductive coil(s) 213, this may in turn heat getter 230 to a temperature above its maximum operating temperature (e.g., >about 20° K) such that the stray molecules which have been captured by getter 230 may be released into chamber 216. If that occurs, an expensive and time-consuming vacuum pump down of cryostat 201 may be required to remove the released molecules.

Accordingly, superconducting magnet system 200 also includes a magnetically controlled or magnetically activated valve 209 in a gas flow path of cooling loop 210. Magnetically activated valve 209 may operate such that when the electrically conductive coil(s) 213 is/are energized to produce a magnetic field having at least a threshold magnetic field gradient, the magnetic field causes (e.g., directly causes) magnetically activated valve 209 to open to thereby allow a flow of the gas through the valve and within cooling loop 210. On the other hand, when the electrically conductive coil(s) 213 do/does not produce the magnetic field having at least the threshold magnetic field gradient, magnetically activated valve 209 is automatically closed so as to prevent flow of the gas across or through magnetically activated valve 209 and within cooling loop 210.

Figure 3:
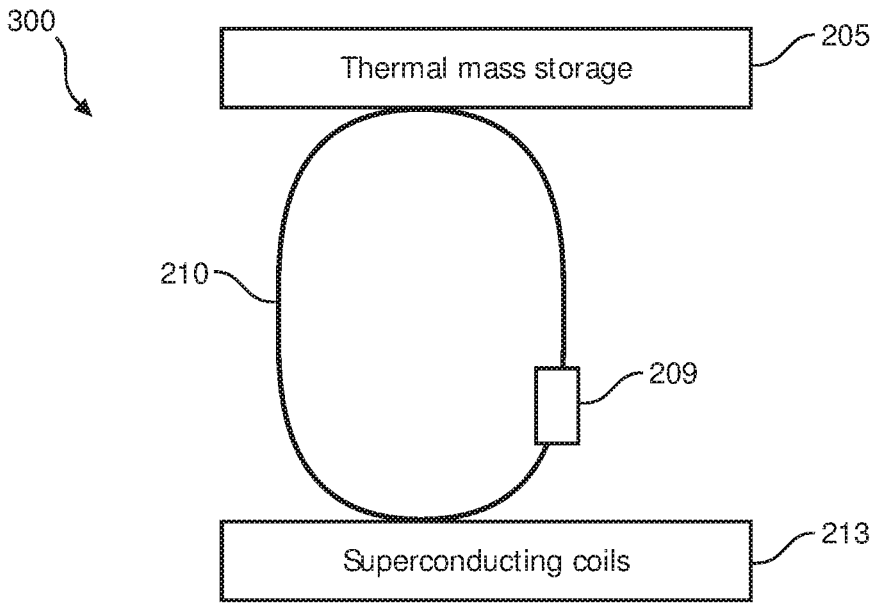
FIG. 3 is a conceptual drawing of a gravity-fed convective cooling arrangement for a superconducting magnet system.

Further explanation of an exemplary operation of a magnetically activated valve and a cooling loop will be provided with respect to FIG. 3. FIG. 3 is a conceptual drawing of a gravity-fed convective cooling arrangement 300 for a superconducting magnet system for example superconducting magnet system 200.

In gravity-fed convective cooling arrangement 300, cold station 205 is disposed at a higher altitude, or position, with respect to earth, than electrically conductive coil(s) 213.

When the electrically conductive coil(s) 213 is/are energized to produce a magnetic field having at least a threshold magnetic field gradient, magnetically activated valve 209 is opened by, or in response to, the magnetic field to thereby allow a flow of the gas through magnetically activated valve 209.

So long as magnetically activated valve 209 is open, when cold station 205 is at a lower temperature (is colder) than electrically conductive coil(s) 213, then the gas (e.g., cooled helium) within cooling loop 210 may circulate by convection and gravity to carry or transfer thermal energy (heat) from electrically conductive coil(s) 213 to cold station 205. That is, when magnetically activated valve 209 is opened by the magnetic field produced by electrically conductive coil(s) 213, and when cold station 205 is at a lower temperature (is colder) than electrically conductive coil(s) 213, then gas which is cooled by cold station 205 is fed by gravity through cooling loop 210 from cold station 205 to electrically conductive coil(s) 213 where the gas absorbs thermal energy and is heated. This heated gas is then carried by convection upward through cooling loop 210 from electrically conductive coil(s) 213. However, even if magnetically activated valve 209 is opened by the magnetic field produced by electrically conductive coil(s) 213, when cold station 205 is at a higher temperature (is hotter) than electrically conductive coil(s) 213, then heated gas will not flow between electrically conductive coil(s) 213 and cold station 205 due to the fact arrangement that cold station 205 is disposed at a higher altitude, or position, with respect to earth, than electrically conductive coil(s) 213.

On the other hand, when electrically conductive coil(s) 213 do/does not produce the magnetic field having at least the threshold magnetic field gradient, magnetically activated valve 209 is automatically closed so as to prevent a flow of gas through magnetically activated valve 209, thereby preventing circulation of the gas within cooling loop 210. This inhibits or prevents transfer of heat from electrically conductive coil(s) 213 to cold station 205 via the gas in cooling loop 210.

The threshold magnetic field gradient which serves as a threshold or switching point for opening and closing of magnetically activated valve 209 may be selected by the design of magnetically activated valve 209, and its location with respect to electrically conductive coil(s) 213, so that magnetically activated valve 209 will remain open in response to the magnetic field generated by electrically conductive coil(s) 213 during normal operation of superconducting magnet system 200, but will close if a quench of the magnetic field generated by electrically conductive coil(s) 213 occurs, or if such a quench is imminent.

Figure 4:
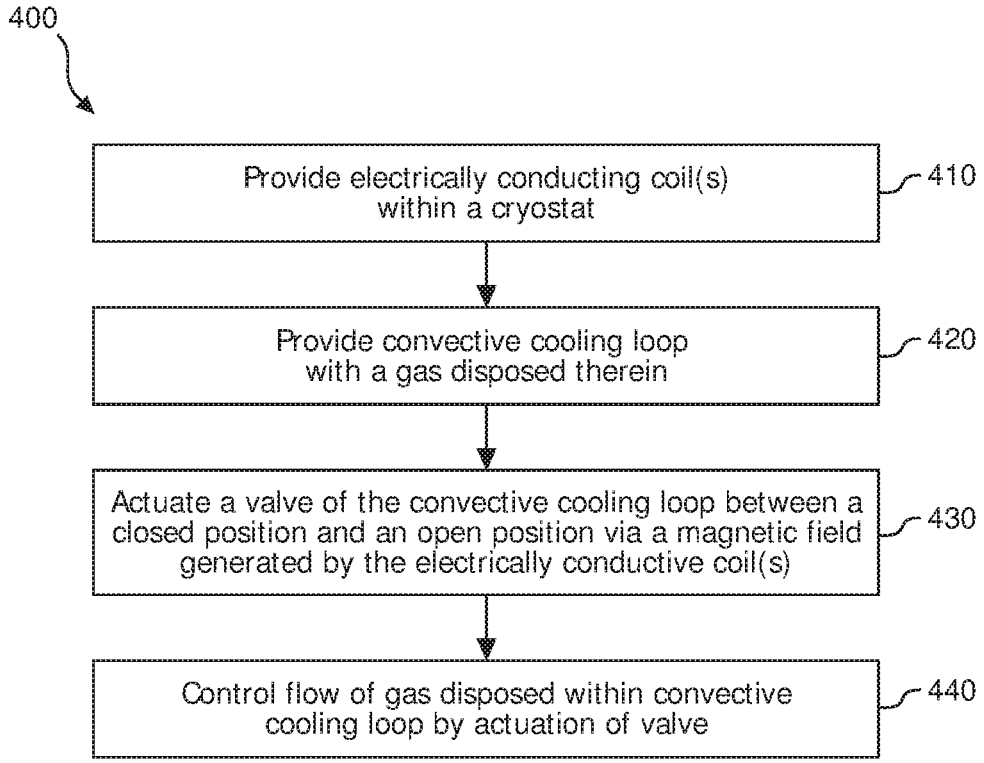
FIG. 4 is a flowchart illustrating an example embodiment of a method of operating a cooling loop.

FIG. 4 is a flowchart illustrating an example embodiment of a method 400 of operating a cooling loop.

In an operation 410, at least one electrically conductive coil is provided within a cryostat, for example a cryostat of a superconducting magnet system such as superconducting magnet system 200 as described above.

In an operation 420, a convective cooling loop is provided within the cryostat. The convective cooling loop has a gas disposed therein, for example cooled helium.

In an operation 430, a valve of the convective cooling loop is actuated between a closed position and an open position via a magnetic field generated by at least one electrically conductive coil disposed within a cryostat.

In an operation 440, actuation of the valve controls a flow of the gas disposed within the convective cooling loop.

Figure 5:
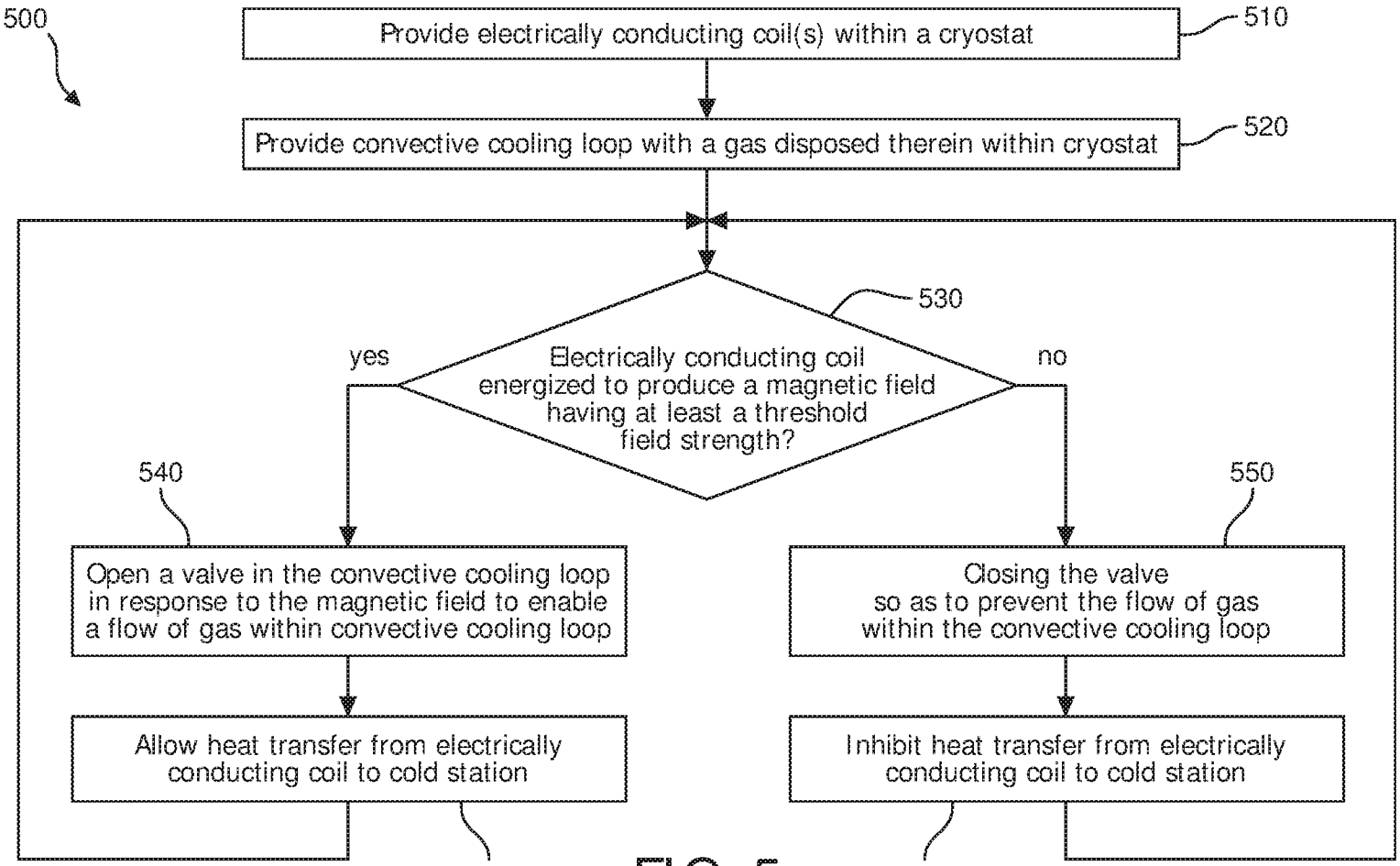
FIG. 5 is another flowchart illustrating an example embodiment of a method of operating a cooling loop.

FIG. 5 is another flowchart illustrating an example embodiment of a method 500 of operating a cooling loop. In particular, method 500 is a method of operating a cooling loop such as cooling loop 210 discussed above with the cooling loop is provided with a magnetically activated valve such as magnetically activated valve 209.

In an operation 510, at least one electrically conductive coil is provided within a cryostat, for example a cryostat of a superconducting magnet system such as superconducting magnet system 200 as described above.

In an operation 520, a convective cooling loop is provided within the cryostat. The convective cooling loop has a gas disposed therein, for example cooled helium.

In an operation 530, a branch occurs whereby method 500 follows one of two paths depending on whether or not the electrically conductive coil is energized to produce a magnetic field having at least a threshold magnetic field gradient.

If or when the electrically conductive coil is energized to produce a magnetic field having at least the threshold magnetic field gradient, then method 500 branches to operation 540 wherein a magnetically activated valve in the gas flow path of the convective cooling loop is opened in response to the magnetic field having at least the threshold magnetic field gradient. That is, the magnetic field produced by the electrically conductive coil causes the magnetically activated valve to open. This enables gas to flow across the magnetically activated valve and within the convective cooling loop. In that case, in an operation 545, when a cold station within the cryostat is at a lower temperature (is colder) than the electrically conductive coil, then thermal energy (heat) may be transferred via the flow of gas within convective cooling loop from the electrically conductive coil to the cold station.

On the other hand, if or when the electrically conductive coil is not energized to produce a magnetic field having at least the threshold magnetic field gradient, then method 500 branches to operation 550 wherein the magnetically activated valve in the gas flow path of the convective cooling loop is automatically closed. This prevents gas from flowing across the magnetically activated valve and within the convective cooling loop. In that case, in operation 555, a transfer of thermal energy (heat) via the flow of gas within convective cooling loop from the electrically conductive coil to the cold station is inhibited or prevented.

Figure 6:
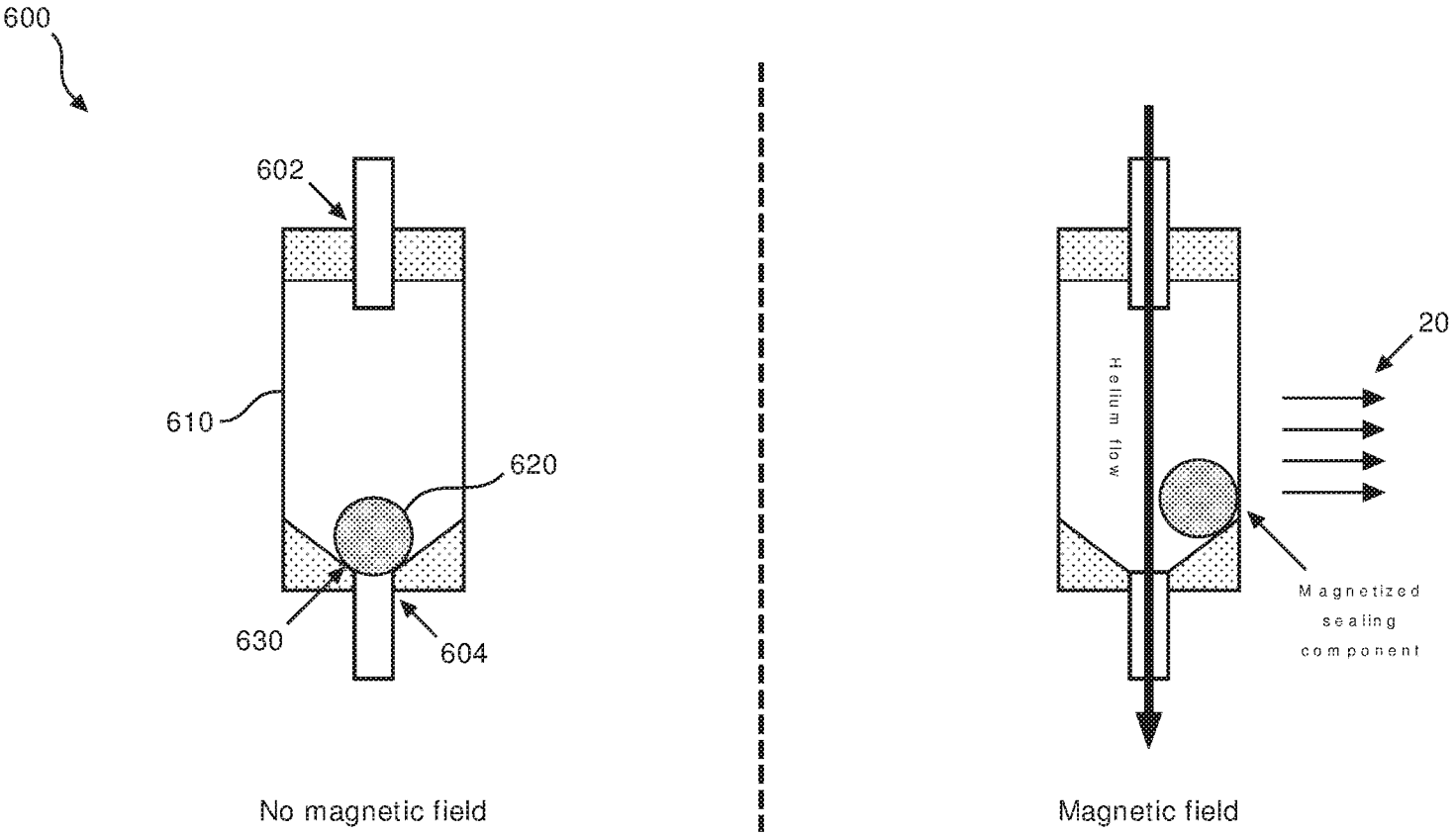
FIG. 6 is a conceptual drawing of a first exemplary embodiment of a magnetically activated valve for a cooling loop of a superconducting magnet system.

FIG. 6 is a conceptual drawing of a first embodiment of a magnetically activated valve 600 for a convective cooling loop of a superconducting magnet system. It should be understood that FIGS. 6-12 are intended to illustrate some major elements and principles of operation of various embodiments of magnetically activated valves, and are not intended to be an engineering drawings of any actual device or devices. The magnetically activated valves which are conceptually illustrated in FIGS. 6-12 may be various embodiments of magnetically activated valve 209 of FIGS. 2 and 3, and the magnetically activated valve described above in the method 400 of FIG. 4 and method 500 of FIG. 5.

Magnetically activated valve 600 includes an inlet 602, an outlet 604, a housing 610, a sealing element 620, and a sealing surface 630. Magnetically activated valve 600 also includes a magnetically reactive element; that is an element which is subject to being moved by a magnetic field gradient. In some embodiments, the magnetically reactive element may include a magnet. In other embodiments, the magnetically reactive element may include a ferromagnetic material, such as iron, nickel, cobalt, permalloy, yttrium iron garnet (YIG), etc. In magnetically activated valve 600, sealing element 620 is or includes the magnetically reactive element.

Magnetically activated valve 600 may be included or integrated in a cooling loop, for example a gravity-fed convective cooling loop as illustrated in FIG. 3. In that case, inlet 602 may be situated "upstream" of outlet 604 so that a gas (e.g., cooled helium) may be received by and enter housing 610 from an upstream portion of the cooling loop, and may exit from outlet 604 into a downstream portion of a cooling loop when magnetically activated valve 600 is open.

In some embodiments, housing 610 may be tubularly shaped. Housing 610 may be hermetically sealed, with the exception of inlet 602 and outlet 604. Beneficially, housing 610 is constructed of a material or materials which is or are penetrable by a magnetic field 20 which is produced by the superconducting magnet (e.g., electrically conductive coil(s)) external to magnetically activated valve 600.

Magnetically activated valve 600 may be closed by virtue of sealing element 620 being pressed against or mated to sealing surface 630, preventing a flow of gas through magnetically activated valve 600 and thereby also preventing circulation of the gas within the cooling loop. In Magnetically activated valve 600, sealing element 620 may be pressed against or mated to sealing surface 630 by one or both of two forces: (1) gravity, and (2) the pressure of the gas in housing 610, magnetically activated valve 600, and the cooling loop.

The left hand side of FIG. 6 illustrates a situation where magnetically activated valve 600 is automatically closed by one or both of the forces mentioned above in the absence of a magnetic field above a threshold amount produced by a superconducting magnet (e.g., electrically conductive coil(s)) external to magnetically activated valve 600 and valve housing 610. Thus, for example, if the magnetic field of such a superconducting magnet is quenched and the magnetic energy is converted to thermal energy which heats the electrically conductive coil(s)), magnetically activated valve 600 may be closed in the absence of the magnetic field so as to inhibit a transfer of thermal energy (heat) from the electrically conductive coil(s)) to a cold station, as described above.

On the other hand, the right hand side of FIG. 6 illustrates a situation where the magnetic field 20 is produced by the superconducting magnet (e.g., electrically conductive coil(s)) external to magnetically activated valve 600. When magnetic field 20 has a sufficient field gradient, the magnetic field causes sealing element 620, which as explained above is or includes a magnetically reactive element, to move or be displaced with respect to sealing surface 630 so as to open magnetically activated valve 600, enabling a flow of gas through magnetically activated valve 600 and thereby also enabling circulation of the gas within the cooling loop.

In magnetically activated valve 600, magnetic field 20 from the external electrically conductive coil(s) is oriented in a direction perpendicular to direction of a flow of the gas from inlet 602 to outlet of magnetically activated valve 600, and also perpendicular to the force of gravity.

Figure 7:
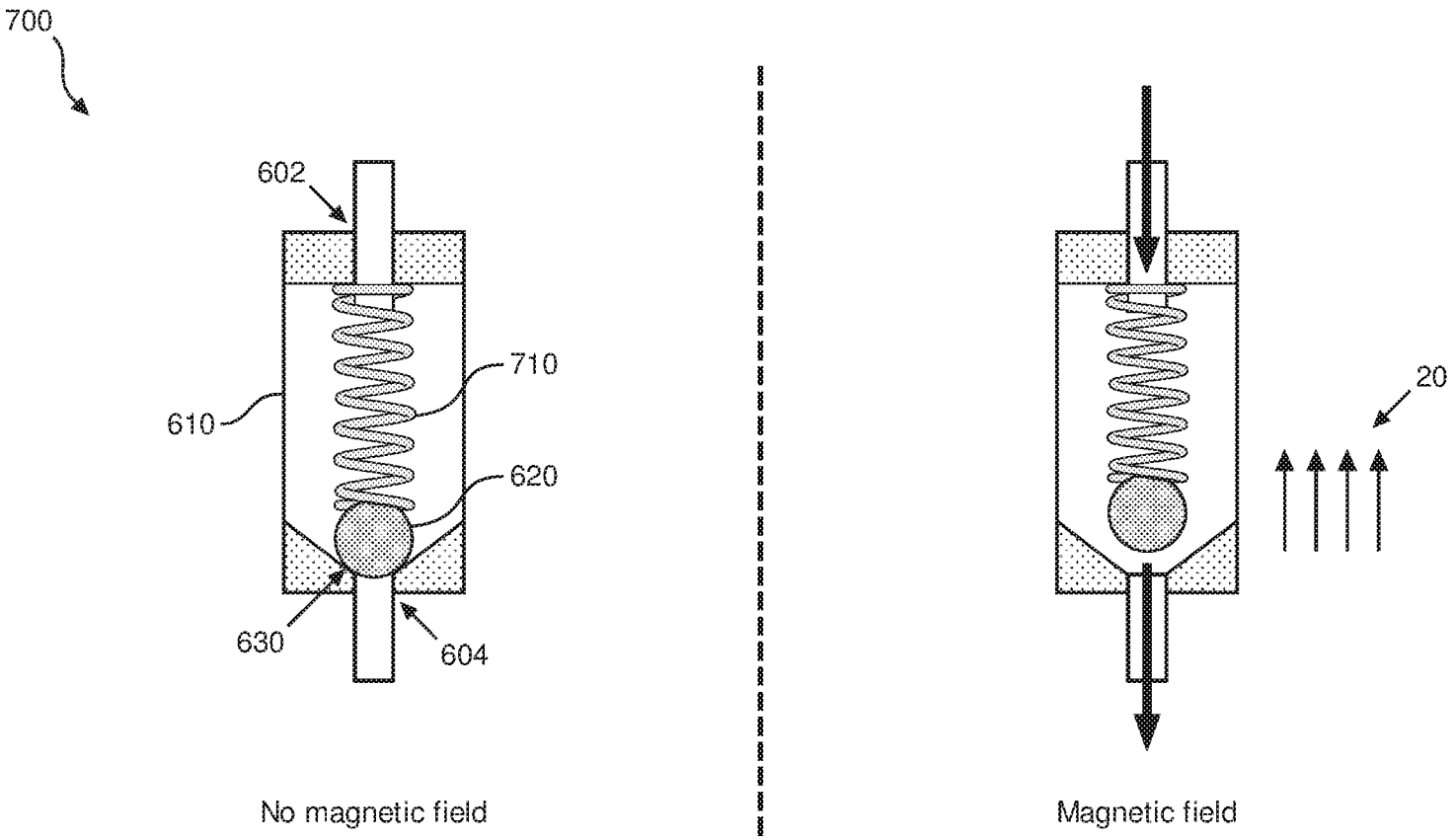
FIG. 7 is a conceptual drawing of a second embodiment of a magnetically activated valve for a cooling loop of a superconducting magnet system.

FIG. 7 is a conceptual drawing of a second embodiment of a magnetically activated valve 700 for a convective cooling loop of a superconducting magnet system.

Magnetically activated valve 700 is constructed and operates similarly to magnetically activated valve 600, so only differences between the two valves with be discussed.

Unlike magnetically activated valve 600, magnetically activated valve 700 includes a spring 710 which applies a force to sealing element 620 so as to press sealing element 620 against, or mate sealing element 620 to, sealing surface 630 in the absence of magnetic field 20.

The left hand side of FIG. 7 illustrates a situation where magnetically activated valve 700 is automatically closed by the force of spring 710 as well as: (1) gravity, and (2) the pressure of the gas in housing 610, in the absence of a magnetic field above a threshold amount produced by a superconducting magnet (e.g., electrically conductive coil(s)) external to magnetically activated valve 700 and valve housing 610. Thus, for example, if the magnetic field of such a superconducting magnet is quenched and the magnetic energy is converted to thermal energy which heats the electrically conductive coil(s)), magnetically activated valve 700 may be closed in the absence of the magnetic field so as to inhibit a transfer of thermal energy (heat) from the electrically conductive coil(s)) to a cold station, as described above.

On the other hand, the right hand side of FIG. 7 illustrates a situation where a magnetic field 20 is produced by the superconducting magnet (e.g., electrically conductive coil(s)) external to magnetically activated valve 700. When magnetic field 20 has a sufficient field gradient to overcome the force of spring 710, as well as: (1) gravity, and (2) the pressure of the gas in housing 610, the magnetic field causes sealing element 620, which as explained above is or includes a magnetically reactive element, to move or be displaced with respect to sealing surface 630 so as to open magnetically activated valve 600, enabling a flow of gas through magnetically activated valve 600 and thereby also enabling circulation of the gas within the cooling loop.

In magnetically activated valve 700, magnetic field 20 from the external electrically conductive coil(s) is oriented in a direction parallel to direction of a flow of the gas from inlet 602 to outlet of magnetically activated valve 600, and also parallel to the force of gravity.

Figure 8:
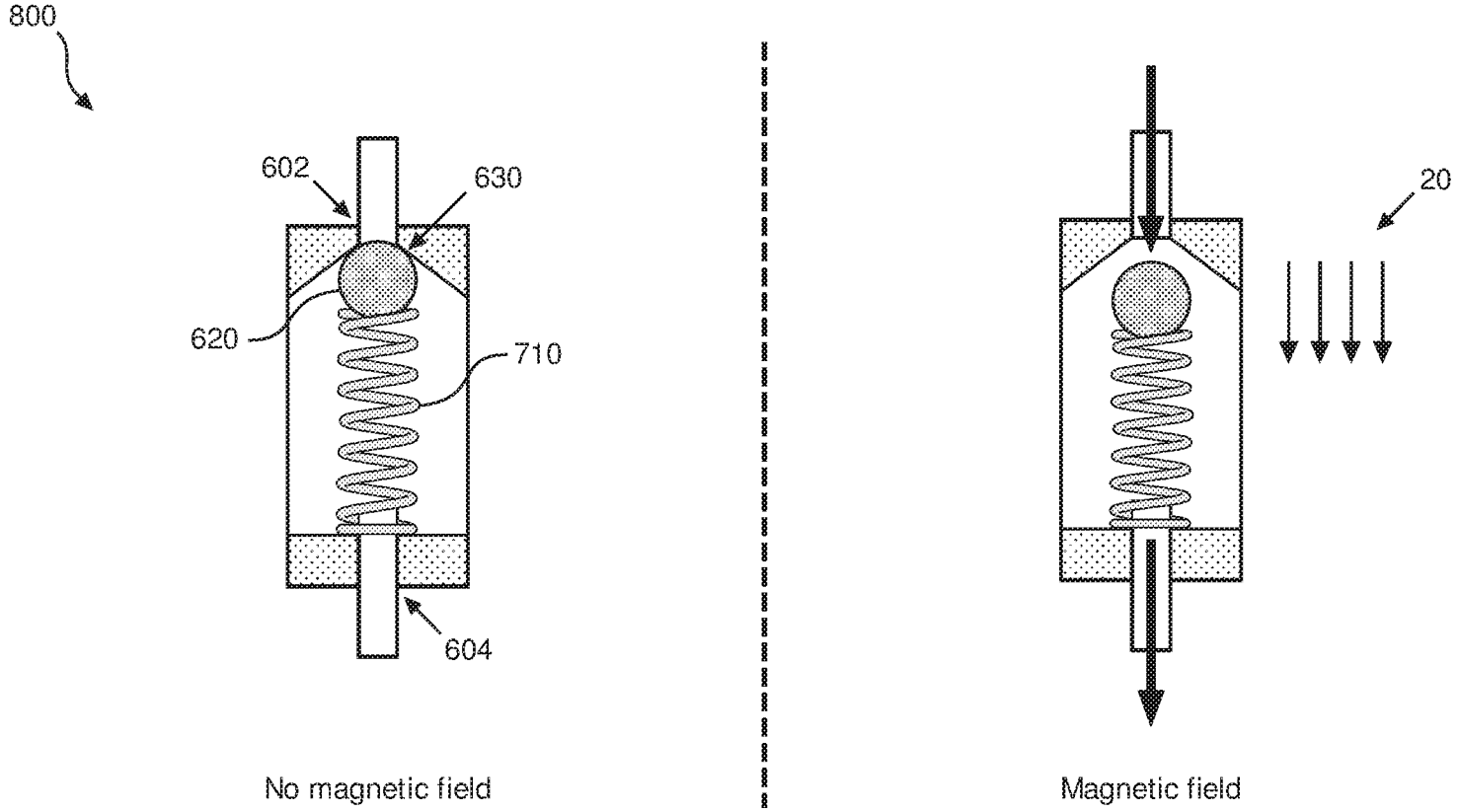
FIG. 8 is a conceptual drawing of a third embodiment of a magnetically activated valve for a cooling loop of a superconducting magnet system.

FIG. 8 is a conceptual drawing of a third embodiment of a magnetically activated valve 800 for a convective cooling loop of a superconducting magnet system.

Magnetically activated valve 800 is constructed and operates similarly to magnetically activated valve 700, so only differences between the two valves with be discussed. A principle difference between magnetically activated valve 700 and magnetically activated valve 800 is as follows. In magnetically activated valve 700, sealing surface 630 is disposed at outlet 604 and magnetically activated valve 700 is closed at outlet 604. In contrast, in magnetically activated valve 800, sealing surface 630 is disposed at inlet 602 and magnetically activated valve 800 is closed at inlet 602. With magnetically activated valve 800 oriented vertically as shown, then the force of spring 710 operates on sealing element 620 in an opposition to the force of gravity.

Figure 9:
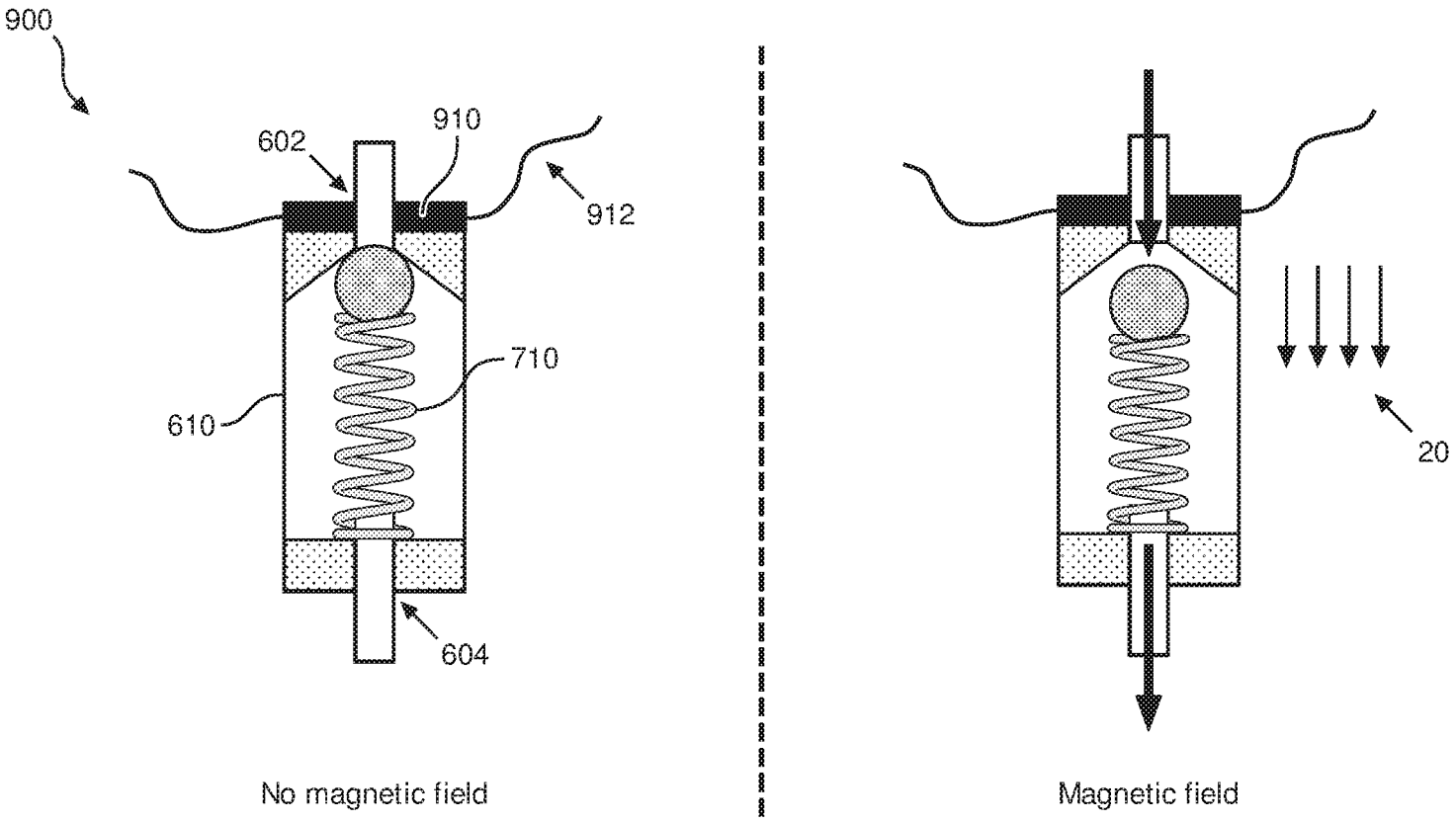
FIG. 9 is a conceptual drawing of a fourth embodiment of a magnetically activated valve for a cooling loop of a superconducting magnet system.

FIG. 9 is a conceptual drawing of a fourth embodiment of a magnetically activated valve 900 for a convective cooling loop of a superconducting magnet system.

Magnetically activated valve 900 is constructed and operates similarly to magnetically activated valve 800, so only differences between the two valves with be discussed.

Magnetically activated valve 900 includes or has associated therewith a magnet 910 external to housing 610. In some embodiments, magnet 910 may comprise one or more electrically conductive coils which are driven by a current supplied through external wires 912. External magnet 910 may be employed for testing of magnetically activated valve 900 and/or for an emergency backup for opening magnetically activated valve 900 in case where magnetic field 20 from the external electrically conductive coil(s) is unable to do so.

Although magnetically activated valve 900 has magnet 910 disposed at inlet 602, in other embodiments magnetically activated valve 900 may have magnet 910 disposed at outlet 604, or other appropriate location such that when magnet 910 is energized, the magnetic field which is produced by magnet 910 is able to move or displace sealing element 620 with respect to sealing surface 630 and thereby open magnetically activated valve 900. It should also be understood that in various embodiments, magnet 910 may be added to or associated with the magnetically activated valves illustrated in FIGS. 6-8 and 10-12.

Figure 10:
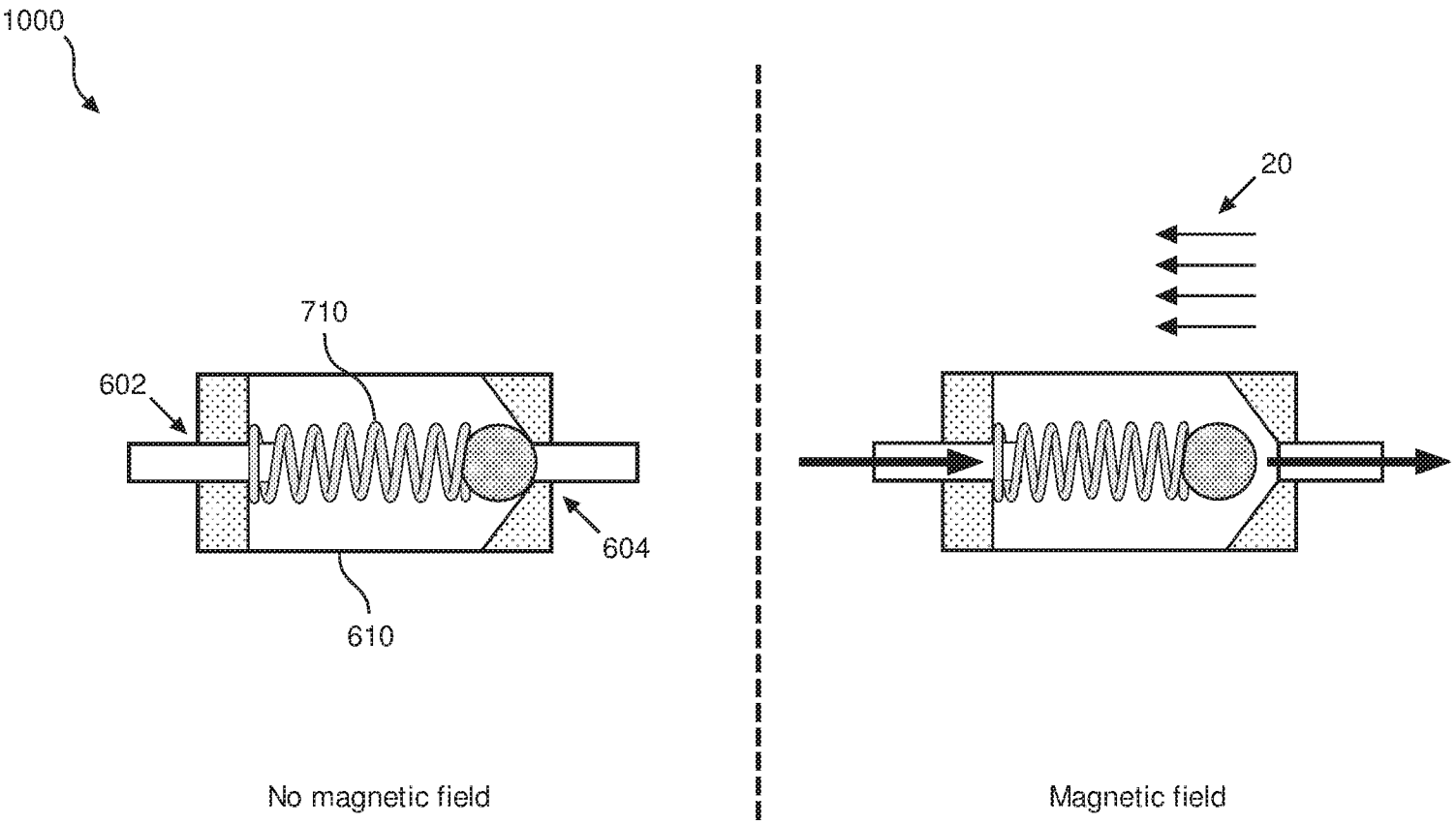
FIG. 10 is a conceptual drawing of a fifth embodiment of a magnetically activated valve for a cooling loop of a superconducting magnet system.

FIG. 10 is a conceptual drawing of a fifth embodiment of a magnetically activated valve 1000 for a convective cooling loop of a superconducting magnet system.

Magnetically activated valve 1000 is constructed and operates similarly to magnetically activated valve 700, so except that where magnetically activated valve 700 is oriented vertically, magnetically activated valve 1000 is oriented horizontally with respect to earth. Accordingly, unlike the case with magnetically activated valve 700, with magnetically activated valve 1000 the force of gravity does not close or assist in closing the valve. It should be understood that in other embodiments, valves which are otherwise identical to magnetically activated valve 800 and magnetically activated valve 900 may be oriented horizontally.

Figure 11:
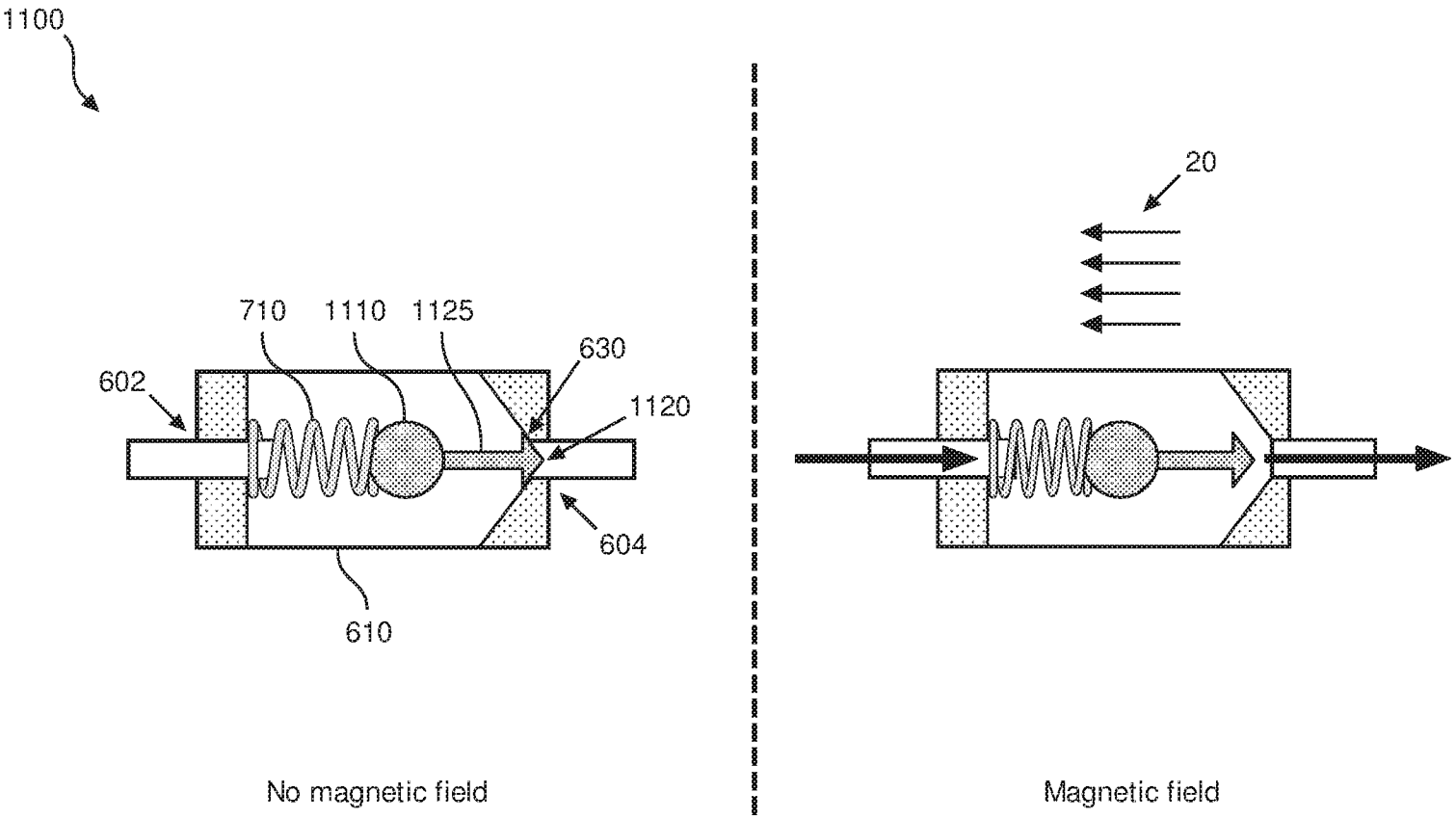
FIG. 11 is a conceptual drawing of a sixth embodiment of a magnetically activated valve for a cooling loop of a superconducting magnet system.

FIG. 11 is a conceptual drawing of a sixth embodiment of a magnetically activated valve 1100 for a convective cooling loop of a superconducting magnet system.

Magnetically activated valve 1100 is constructed and operates similarly to magnetically activated valve 1000, so only differences between the two valves will be discussed.

Magnetically activated valve 1100 includes a magnetically reactive element 1110 which is separate from but connected to sealing element 1120. Here, sealing element 1120 may be non-magnetically reactive. For example, sealing element 1120 may be made of any rubber, plastic, non-magnetic metals, or any combination thereof. In magnetically activated valve 1100, magnetically reactive element 1110 is connected or attached to sealing element 1120 by a connection element 1125. In some embodiments, connection element 1125 may be non-magnetically reactive. In some embodiments, connection element 1125 may comprise a flexible or compressible material, such as rubber. In some embodiments, connection element 1125 may comprise a spring. In some embodiments, connection element 1125 may be omitted and magnetically reactive element 1110 may be directly connected to sealing element 1120.

The left hand side of FIG. 11 illustrates a situation where magnetically activated valve 1100 is automatically closed by the force of spring 710 upon magnetically reactive element 1110, and thereby on sealing element 1120, in the absence of a magnetic field above a threshold amount produced by a superconducting magnet (e.g., electrically conductive coil(s)) external to magnetically activated valve 1100 and valve housing 610. Thus, for example, if the magnetic field of such a superconducting magnet is quenched and the magnetic energy is converted to thermal energy which heats the electrically conductive coil(s)), magnetically activated valve 1100 may be closed in the absence of the magnetic field so as to inhibit a transfer of thermal energy (heat) from the electrically conductive coil(s)) to a cold station, as described above.

On the other hand, the right hand side of FIG. 11 illustrates a situation where a magnetic field 20 is produced by the superconducting magnet (e.g., electrically conductive coil(s)) external to magnetically activated valve 1100. When magnetic field 20 has a sufficient magnetic field gradient to overcome the force of spring 710, the magnetic field causes magnetically reactive element 1110 to move or be displaced with respect to sealing surface 630, which in turn moves or displaces sealing element 1120 with respect to sealing surface 630 so as to open magnetically activated valve 1100, enabling a flow of gas through magnetically activated valve 1100 and thereby also enabling circulation of the gas within the cooling loop.

It should be understood that the principle of separating the magnetically reactive element from the sealing element may be applied to other embodiments of a magnetically activated valve, for example magnetically activated valves 700, 800, 900, etc.

Figure 12:
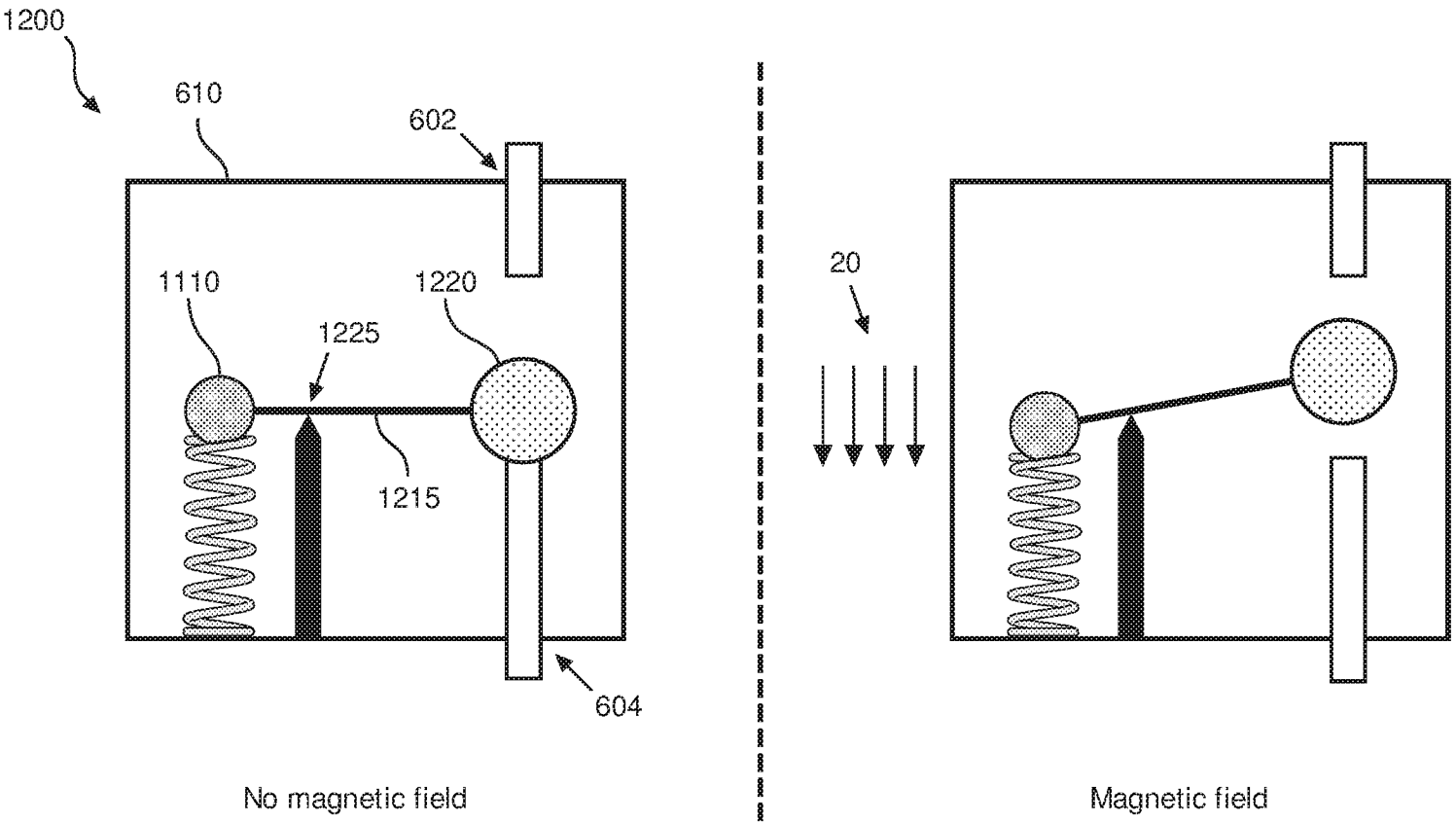
FIG. 12 is a conceptual drawing of a seventh embodiment of a magnetically activated valve for a cooling loop of a superconducting magnet system.

FIG. 12 is a conceptual drawing of a seventh embodiment of a magnetically activated valve 1200 for a convective cooling loop of a superconducting magnet system.

Magnetically activated valve 1200 employs a lever effect, which may be used for example to reduce the amount of magnetic force which may be required to open magnetically activated valve 1200. Magnetically activated valve 1200 includes a lever having a beam 1215 and a fulcrum 1225, and wherein magnetically reactive element 1110 is disposed at a first end of the lever at a first side of fulcrum 1225, and sealing element 1220 is disposed at a second end of the lever at a second side of fulcrum 1225. Magnetically reactive element 1110 may be attached to, or integrated with, a first end of beam 1215, and sealing element 1220 may be attached to, or integrated with, a second end of beam 1215.

The left hand side of FIG. 12 illustrates a situation where magnetically activated valve 1200 is automatically closed by the force of spring 710 upon magnetically reactive element 1110, and thereby via the lever effect of beam 1215 and fulcrum 1225 on sealing element 1220, in the absence of a magnetic field above a threshold amount produced by a superconducting magnet (e.g., electrically conductive coil(s)) external to magnetically activated valve 1200 and valve housing 610. Thus, for example, if the magnetic field of such a superconducting magnet is quenched and the magnetic energy is converted to thermal energy which heats the electrically conductive coil(s)), magnetically activated valve 1200 may be closed in the absence of the magnetic field so as to inhibit a transfer of thermal energy (heat) from the electrically conductive coil(s)) to a cold station, as described above.

On the other hand, the right hand side of FIG. 12 illustrates a situation where a magnetic field 20 is produced by the superconducting magnet (e.g., electrically conductive coil(s)) external to magnetically activated valve 1200. When magnetic field 20 has a sufficient magnetic field gradient or torque to overcome the force of spring 710, the magnetic field causes magnetically reactive element 1210 to move or be displaced, which in turn moves or displaces sealing element 1220 with respect to sealing surface 630 so as to open magnetically activated valve 1200, enabling a flow of gas through magnetically activated valve 1200 and thereby also enabling circulation of the gas within the cooling loop. Because of the lever effect, in some embodiments only a relatively small movement or displacement of magnetically reactive element 1210 by magnetic field 20 may produce a larger displacement or movement of sealing element 1220 with respect to sealing surface 630.

Although embodiments of valves have been described above which are configured to be normally closed in the absence of a magnetic field, and to be opened via magnetic field 20 which is produced by a superconducting magnet (e.g., electrically conductive coil(s)), in other embodiments the valves may be reconfigured to be normally opened in the absence of a magnetic field, and to be closed via magnetic field 20. As a simple example, considering FIG. 8, if the nominal position of sealing component 620 in the absence of a magnetic field was separated and spaced apart from sealing surface 630 as shown on the right hand side of FIG. 8, and if the direction of magnetic field 20 was reversed, then the valve may normally opened in the absence of a magnetic field, and may be closed via magnetic field 20 as shown on the left hand side of FIG. 8. Other configurations of such a valve are contemplated.

While preferred embodiments are disclosed herein, many variations are possible which remain within the concept and scope of the invention. Such variations would become clear to one of ordinary skill in the art after inspection of the specification, drawings and claims herein. The present invention therefore is not to be restricted except within the scope of the appended claims.

What is claimed is:

1. A method, comprising:

cooling a superconducting coil of a magnetic resonance imaging (MRI) apparatus by a cold head via a principal cooling mechanism, wherein the superconducting coil is disposed within a cryostat of the MRI apparatus;

controlling flow of a gas disposed within a convective cooling loop configured to transfer heat from the superconducting coil to a cold station having a thermal mass greater than a thermal mass of the superconducting coil by actuating a valve of the convective cooling loop between a closed position and an open position via a magnetic field generated by superconducting coil; and subsequent to a loss of operation of the principal cooling mechanism, cooling the superconducting coil by the convective cooling loop wherein the valve of the convective cooling loop is open subsequent to the loss of operation of the principal cooling mechanism due to the magnetic field being generated by the superconducting coil;

wherein the controlling of the flow of the gas disposed within the convective cooling loop includes actuating the valve from the open position to the closed position in response to the superconducting coil ceasing to generate the magnetic field thereby stopping cooling of the superconducting coil by the convective cooling loop.

2. The method of claim 1, wherein the principal cooling system comprises a sealed system having a liquid helium disposed therein.

3. The method of claim 1, wherein actuating the valve in the convective cooling loop comprises displacing a magnetically reactive sealing element of the valve with respect to a sealing surface of the valve in response to the magnetic field having at least a threshold magnetic field gradient to open the valve.

4. The method of claim 1, wherein actuating the valve in the convective cooling loop comprises displacing a magnetically reactive element of the valve in response to the magnetic field having at least a threshold magnetic field gradient, wherein displacing the magnetically reactive element causes a nonmagnetic sealing element of the valve to be displaced with respect to a sealing surface of the valve to open the valve.

5. The method of claim 1, wherein actuating the valve in the convective cooling loop comprises employing at least one of gravity and a force produced by a pressure of the gas to cause a sealing element of the valve to be disposed against a sealing surface of the valve to close the valve.

6. The method of claim 1, wherein actuating the valve in the convective cooling loop comprises employing a force produced by a spring in the valve to cause a sealing element of the valve to be disposed against a sealing surface of the valve to close the valve.

7. The method of claim 1, wherein actuating the valve in the convective cooling loop in response to the magnetic field comprises applying the magnetic field oriented in a direction perpendicular to direction of a flow of the gas from an inlet of the valve to an outlet of the valve to open the valve.

8. The method of claim 1, wherein actuating the valve in the convective cooling loop in response to the magnetic field comprises applying the magnetic field oriented in a direction parallel to direction of a flow of the gas from an inlet of the valve to an outlet of the valve to open the valve.

9. An apparatus, comprising:

a cryostat including a cold plate enclosing a cryogenic fluid;

a convective cooling loop; and a valve configured to be actuated between an open position and a closed position via a magnetic field generated by at least one electrically conductive coil disposed within the cold plate, wherein the valve controls a flow of a gas disposed within the convective cooling loop.

10. The apparatus of claim 9, wherein the valve comprises: a sealing element and a sealing surface configured so that when the electrically conductive coil is not energized, the sealing element is mated to the sealing surface such that the valve is closed so as to prevent the flow of the gas within the cooling loop, and a magnetically reactive element, wherein in response to the magnetic field of the electrically conductive coil, the magnetically reactive element is configured to cause the sealing element to be displaced with respect to the sealing surface such that the valve is opened and the flow of the gas within the cooling loop is enabled.

11. The apparatus of claim 10, wherein the magnetically reactive element comprises a ferromagnetic material.

12. The apparatus of claim 10, wherein the sealing element comprises the magnetically reactive element.

13. The apparatus of claim 10, wherein the sealing element is nonmagnetic, and wherein the magnetically reactive element is attached to the sealing element such that when the magnetically reactive element is displaced by the magnetic field of the electrically conductive coil, the magnetically reactive element in turn displaces the sealing element with respect to the sealing surface such that the valve is opened.

14. The apparatus of claim 10, wherein when the electrically conductive coil is not energized, the sealing element is held against the sealing surface at least partially by gravity to close the valve.

15. The apparatus of claim 10, wherein the valve further includes a spring, wherein when the electrically conductive coil is not energized, the sealing element is held against the sealing surface at partially by a force produced by the spring to close the valve.

16. The apparatus of claim 10, wherein the valve further includes a lever having a beam and a fulcrum, and wherein the magnetically reactive element is disposed at a first end of the lever at a first side of the fulcrum, and the sealing element is disposed at a second end of the lever at a second side of the fulcrum, wherein when the magnetically reactive element is displaced by the magnetic field of the electrically conductive coil it operates the lever so as to displace the sealing element with respect to the sealing surface such that the valve is opened.

17. The apparatus of claim 9, further comprising a magnet separate and apart from the electrically conductive coil, wherein the magnet is associated with the valve and is configured such that when the magnet is energized, the valve is opened.

18. An apparatus, comprising:

a cryostat including a cold plate enclosing a cryogenic fluid;

at least one superconducting coil and a valve both disposed within the cold plate;

a convective cooling loop; and wherein the valve is configured to be actuated between an open position and a closed position directly via a magnetic field generated by the at least one superconducting coil disposed within the cryostat, wherein the valve controls a flow of a gas disposed within the convective cooling loop.

19. The apparatus of claim 18 further comprising:

a magnetic resonance imaging (MRI) apparatus including a superconducting magnet system comprising the cryostat and the superconducting coil disposed in the cryostat.

* * * * *